US009415890B2

(12) United States Patent
Wurst et al.

(10) Patent No.: US 9,415,890 B2
(45) Date of Patent: Aug. 16, 2016

(54) DEVICE FOR OPENING AND EMPTYING FILLED TWO-PIECE CAPSULES

(75) Inventors: Reiner Wurst, Auenwald (DE); Klaus Käfer, Weissach im Tal (DE)

(73) Assignee: Harro Höfliger Verpackungsmaschinen GmbH, Allmersbach (DE)

( * ) Notice: Subject to any disclaimer, the term of this patent is extended or adjusted under 35 U.S.C. 154(b) by 479 days.

(21) Appl. No.: 14/114,224

(22) PCT Filed: May 4, 2012

(86) PCT No.: PCT/EP2012/001905

§ 371 (c)(1),
(2), (4) Date: Oct. 28, 2013

(87) PCT Pub. No.: WO2012/152412

PCT Pub. Date: Nov. 15, 2012

(65) Prior Publication Data

US 2014/0053504 A1 Feb. 27, 2014

(30) Foreign Application Priority Data

May 11, 2011 (DE) ..... 20 2011 100 502

(51) Int. Cl.

| | |
|---|---|
| ***B65B 69/00*** | (2006.01) |
| ***B65B 43/00*** | (2006.01) |
| ***A61J 3/07*** | (2006.01) |

(52) U.S. Cl.

CPC ..... *B65B 69/00* (2013.01); *A61J 3/074* (2013.01); *B65B 69/005* (2013.01)

(58) Field of Classification Search

CPC ..... B65B 69/00; B65B 69/005; A61J 3/074
USPC ..... 53/381.1, 381.4, 900
See application file for complete search history.

(56) References Cited

U.S. PATENT DOCUMENTS

| | | | | |
|---|---|---|---|---|
| 8,621,825 | B2 * | 1/2014 | Schmied | 53/244 |
| 2008/0236106 | A1 * | 10/2008 | Trebbi | A61J 3/072 53/471 |

FOREIGN PATENT DOCUMENTS

| | | | |
|---|---|---|---|
| AT | 397 764 | B | 6/1994 |
| DE | 20 2010 005594 | U1 | 9/2010 |

* cited by examiner

*Primary Examiner* — Gloria R Weeks
*Assistant Examiner* — Eyamindae Jallow
(74) *Attorney, Agent, or Firm* — Gudrun E. Huckett

(57) ABSTRACT

A device for opening and emptying filled two-piece capsules, each having a capsule lower part and a capsule upper part, comprises a separator block for separating the capsule lower part from the capsule upper part. A guide pusher is provided for pressing individual two-piece capsules into the separator block in a pressing direction. The separator block has a first clamping track for the lower capsule part and a second clamping track for the capsule upper part. The clamping track have a direction of advancement in which the capsule upper part or capsule lower part can be moved by the guide pusher and be clamped perpendicularly thereto. The two clamping tracks are inclined such that their directions of advancement diverge at an angle to the pressing direction of the guide pusher.

12 Claims, 3 Drawing Sheets

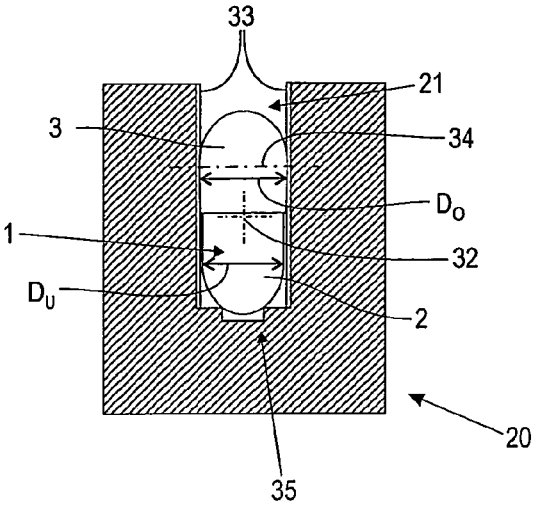
Fig. 2
Fig. 3
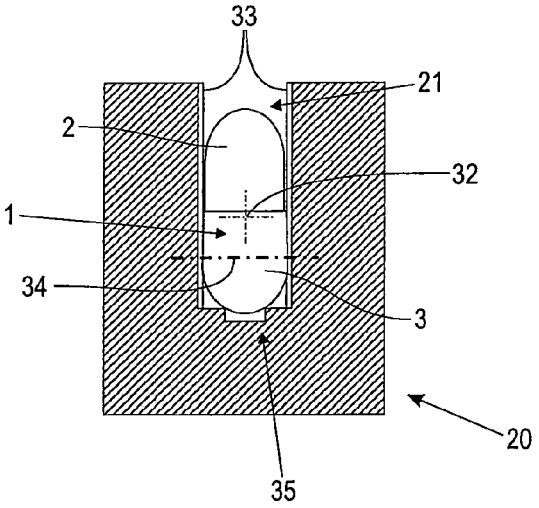
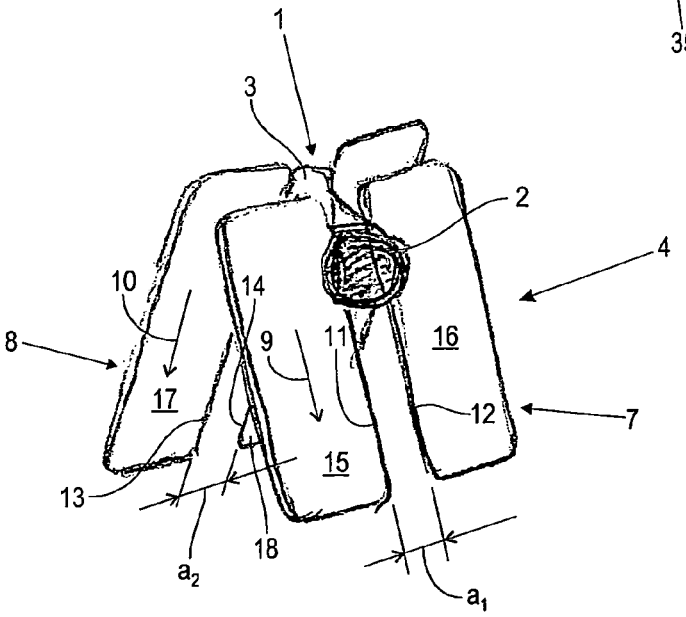
Fig. 4

DEVICE FOR OPENING AND EMPTYING FILLED TWO-PIECE CAPSULES

BACKGROUND OF THE INVENTION

The invention concerns a device for opening and emptying filled two-piece capsules. For example, in the field of pharmacy and food supplements, so-called two-piece capsules are used in which an active ingredient preparation is contained and which are designed to be swallowed by the user. Such two-piece capsules are comprised, for example, of hard gelatine or of HPMC (hydroxypropyl methylcellulose) or the like, wherein the capsule material after having been swallowed will dissolve and release the active ingredient preparation. The two-piece capsules are formed of a capsule bottom part and a capsule top part, wherein first the capsule bottom part is filled and then subsequently a capsule top part is pushed onto the filled capsule bottom part. The plug connection is sufficiently strong so that the two parts will not accidentally detach from each other.

When filling two-piece capsules, specifications with regard to metering precision are stringent. However, these specifications are not always fulfilled. Due to the metering system, the quality of the metered material, and also other conditions, high reject rates may be produced. Particular in case of high-quality or high-priced filling material, there is the need in such a case to recover the filling material, if possible, without contaminations.

The invention has the object to provide a device for opening and emptying filled two-piece capsules with which a recovery, that is economic and gentle to the material, of the filling material from the filled and closed two-piece capsules is possible.

SUMMARY OF THE INVENTION

The object is solved by a device that comprises a separator block for separating capsule bottom part and capsule top part as well as a guide pusher for pushing an individual two-piece capsule into the separator block in a pushing direction. The separator block has a first clamping path for the capsule bottom part and a second clamping path for the capsule top part, wherein the clamping paths are designed such that they each have an advancing direction in which the capsule bottom part or the capsule top part can be moved by means of the guide pusher and, during this movement, are clamped perpendicularly thereto. The two clamping paths are slanted relative to each other such that their respective advancing directions relative to the pushing direction of the guide pusher diverge at an opening angle.

With the aforementioned clamping action, the capsule bottom part and capsule top part are forced into paths that are diverging relative to each other while they follow the advancing action of the guide pusher. As a result of the aforementioned clamping action, the diverging paths cause the capsule bottom part and the capsule top part, starting with their closed plug position, to move away from each other and to finally be completely separated. The precious filling material can be removed and can be supplied to a further filling process or another after-processing step. Opening of the two-piece capsule is realized with only minimal loading of the capsule material so that capsule damage and contamination of the filling material caused thereby are reliably avoided. High cycle rates are possible. A compact configuration results that enables installation of the device according to the invention in existing GMP (good manufacturing practice) rooms, for example, also in those rooms in which the filling and closing machine is located.

According to an advantageous further embodiment, the clamping paths each have a pair of at least approximately parallel clamping edges facing each other wherein the pair of parallel clamping edges of the first clamping path are positioned at the opening angle relative to the pair of parallel clamping edges of the second clamping path. In particular, the pairs of clamping edges are formed on pairs of clamping plates. The arrangement is constructively simple with respect to its configuration and is reliable with respect to its clamping guiding action. The capsule parts which are secured by clamping action between the clamping edges can be moved with minimal force expenditure and without excessive loading of the capsule material in the respective advancing direction. At the same time, the clamping edges prevent sliding of the capsule part secured therein perpendicular to the advancing direction, respectively, so that the two-piece capsule is reliably opened along the advancing path of the guide pusher.

In an advantageous embodiment, the separator block has upstream thereof a sorting device for oriented alignment and supply of an individual two-piece capsule to the separator block wherein the first clamping path is matched to the diameter of the capsule bottom part and the second clamping path to the diameter of the capsule top part.

The sorting device ensures that the two-piece capsules that are initially supplied unoriented are oriented such that, independent of their supply orientation, the capsule bottom part is always supplied to the correlated first clamping path and the capsule top part always to the correlated second clamping path. The individual adjustment to the capsule top and capsule bottom parts that differ with regard to their diameter enables a precisely predetermined clamping action on the capsule bottom part and the capsule top part without one of them being overloaded or subjected to a clamping action that is too low. The adjustment of the separator block to the diameter differences of the two-part capsule parts enables a safe and destruction-free opening of the capsule.

In connection with the sorting device and the configuration of the clamping paths with clamping edges, a proper longitudinal guiding action and clamping action transversely thereto are achieved in that the spacing between the clamping edges of the first clamping path is smaller by a first clamping measure than the diameter of the capsule bottom part and in that the spacing between the clamping edges of the second clamping path is smaller by a second clamping measure than the diameter of the capsule top part.

The sorting device has advantageously a sorting block with an ejector passage for receiving two-piece capsules that are supplied unoriented as well as a sorting pusher for oriented turning within the ejector passage and for removing the turned and oriented two-piece capsules from the ejector passage. In this connection, the effect is utilized that the closed capsules have their maximum diameter and also their maximum stiffness in the area of the spherical top part. In this area, the two-piece capsule is secured in the ejector passage with minimal clamping action wherein the site of the clamping action determines an eccentric pivot axis. The laterally supplied sorting pusher that hits the two-piece capsule centrally causes first a turning movement of the two-piece capsule in such a way that its thinner capsule bottom part in the ejecting direction of the sorting pusher is pointing forwardly. This applies likewise to two-piece capsules with capsule top part positioned at the top or at the bottom. After completed turning, the two-piece capsule independent of its initial position is ejected, with the thinner capsule bottom part leading, and supplied to the separator block in correct position so that an unequivocal assignment of capsule bottom part and capsule top part to the respective clamping path is ensured. In particular, the clamping paths and the sorting block can be designed as so-called format parts so that, with otherwise identical configuration of the device according to the invention, all conventional and differently designed two-piece capsule sizes can be processed.

In a preferred further embodiment, the sorting device has a capsule supply for the sorting block that performs a lifting stroke. In this connection, the lifting movement of the guide pusher is coupled with the lifting movement of the capsule supply which advantageously can be achieved by a fixed attachment of the guide pusher at the capsule supply. Without additional control expenditure, it is ensured that the processes of capsule orientation and capsule opening will be performed synchronous to each other. This contributes to operational safety at high cycle rates.

For the opening angle between the clamping paths there is some freedom with respect to design. It has been found to be advantageous that the opening angle is within a range of including 10° to including 50° and preferably in a range of including 20° to including 40° and in particular at least approximately 30°.

In an expedient further embodiment of the invention, below the separator block a separating device for separating the opened capsule bottom parts and capsule top parts from the contents of the capsule is arranged. Preferably, the separating device is formed by a vibrating screen and a collecting container for the capsule contents that is arranged below the vibrating screen. The vibrating screen retains the opened two-piece capsules while the capsule contents fall through the mesh of the screen into the collecting container. For a sufficiently narrow mesh size, also fragments of accidentally destroyed capsule parts can be retained so that a high degree of purity of the recovered capsule contents is ensured. The vibrating screen ensures also due to its vibrating movement that the entire capsule contents is removed from the vibrated capsule top parts and capsule bottom parts and supplied through the screen to the collecting container.

BRIEF DESCRIPTION OF THE DRAWINGS

One embodiment of the invention will be explained in the following with the aid of the drawing in more detail. It is shown in:

FIG. 2 a schematic cross-sectional illustration of the sorting block with introduced two-piece capsule according to FIG. 1;

FIG. 3 the arrangement according to FIG. 2 with two-piece capsule inserted in reverse arrangement;

FIG. 4 in a perspective schematic illustration a part of the separator block according to FIG. 1 with clamped two-piece capsule;

DESCRIPTION OF PREFERRED EMBODIMENTS

Figure 1:
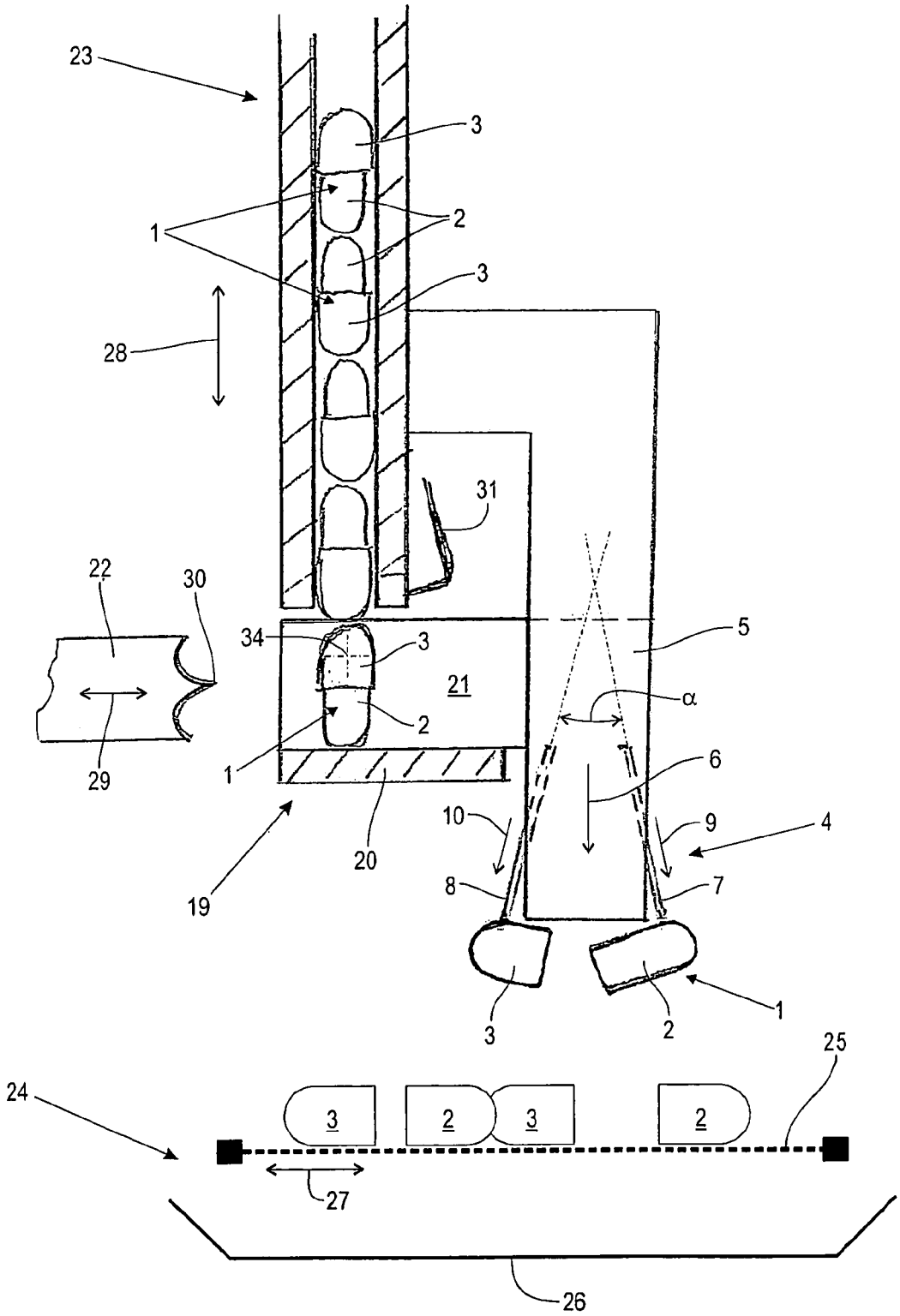
FIG. 1 in a schematic partially sectioned side view a device according to the invention for opening and emptying filled two-piece capsules with a sorting block, with a separator block, and with a separating device for separating the capsule contents.

FIG. 1 shows in a schematic partially sectioned side view one embodiment of the device according to the invention for opening and emptying filled two-piece capsules 1. Each individual two-piece capsule 1 is comprised of a capsule bottom part 2 as well as a pushed-on capsule top part 3. The two-piece capsules 1 or their capsule bottom parts 2 and capsule top parts 3 are comprised of hard gelatine, HPMC or the like, and contain an active ingredient preparation which is in particular in the form of a fine-grain powder. The illustrated device according to the invention is provided to recover the contents of the capsule in case of improper filling of the two-piece capsules 1 or for other reasons. The device comprises a capsule supply 23, a sorting device 19, a separator block 4, as well as a separating device 24.

By means of the capsule supply 23 in the form of a vertically oriented passage. filled two-part capsules 1 are supplied from a storage container, not illustrated, to the sorting device 19. The vertical passage of the capsule supply 23 has for this purpose a cross-section that is slightly greater than the diameter of the two-piece capsules 1 so that the two-piece capsules 1 can fall in vertical alignment in a row atop each other through the passage into the sorting device 19. The two-piece capsules 1 are unoriented within the capsule supply 23 such that randomly either a capsule bottom part 2 or a capsule top part 3 will be positioned facing downwardly.

The sorting device 19 comprises a sorting block 20 with a horizontally arranged and upwardly open ejector passage 21 as well as a sorting pusher 22 that is horizontally moveable in oscillation in accordance with a double arrow 29 and that has a tip 30 that is facing the ejector passage 21.

The separator block 4 is provided for separation of capsule bottom part 2 and capsule top part 3, beginning with the pushed-on state, and comprises a first clamping path 7 for an individual clamping bottom part 2 as well as a second clamping path 8 for an individual capsule top part 3. The first camping path 7 has an advancing direction 9 while the second clamping path 8 has an advancing direction 10. Moreover, a guide pusher 5 which is acting on an individual two-piece capsule 1 is provided which, in the illustrated embodiment, is rigidly connected to the capsule supply 23 and is movable in oscillation together with it in accordance with a double arrow 28 up and down in the vertical direction. Due to the rigid or fixed connection of the guide pusher 5 with the capsule supply 23, the lifting movement of the guide pusher 5 is coupled with the lifting movement of the capsule supply 23 in accordance with double arrow 28. However, a rigid connection between the two components can be omitted wherein then both lifting movements are driven separately and are coordinated or synchronized by means of a suitable control unit.

During the downward phase, the guide pusher 5 moves in pushing direction 6 and forces an individual two-piece capsule 1 into the separator block 4. The two clamping paths 7, 8 are slanted relative to each other such that their advancing movements 9, 10 relative to the vertical pushing direction 6 of the guide pusher 5 diverge at an opening angle $\alpha$. The opening angle $\alpha$ is expediently in a range of including 10° to including 50° and preferably in a range of including 20° to including 40°. In the illustrated embodiment, the opening angle $\alpha$ is at least approximately 30°.

Below the separator block 4, the separating device 24 for separating the opened bottom parts 2 and capsule top parts 3 from their capsule contents is arranged. In the illustrated embodiment, the separating device 24 is formed by a vibrating screen 25 as well as by a collecting container 26 for the capsule contents arranged underneath the vibrating screen 25. The vibrating screen 25 is oscillatingly movable in horizontal direction by means of a drive, not illustrated, in accordance with double arrow 27. In addition or alternatively, a vertical oscillating movement can be provided also.

FIG. 2 shows in a schematic cross-sectional illustration the sorting block 20 according to FIG. 1 with an individual two-piece capsule 1 which is upright within the ejector passage 21 and resting on its passage bottom 35. In the illustrated case, the capsule bottom part 2 is positioned at the top while the capsule bottom part 3 is positioned at the bottom. The capsule top part 3 has a diameter $D_o$ that is greater by such a measure than the diameter $D_u$ of the capsule bottom part 2 that the capsule bottom part 2 can be inserted in a clamping fashion into the capsule bottom part 3. The ejector passage 21 which is open in upward direction is laterally delimited by parallel extending passage walls 33 wherein their spacing relative to each other is somewhat smaller than the diameter $D_o$ of the capsule top part 3 but greater than the diameter $D_u$ of the capsule bottom part 2. In this way, the two-piece capsule 1 is clamped between the passage walls 33 in the area of the capsule top part 3 such that at the site of maximum surface pressure, i.e., at the transition area of cylindrical section to the spherical section of the capsule top part 3, a horizontal pivot axis 34 is formed. When looking jointly at FIGS. 1 and 2, it is apparent that the sorting pusher 22 with its tip 30 is adjusted in vertical direction such that the sorting pusher 22 with its tip 30 upon horizontal advancing movement will impinge on a contact point 32 which is approximately located at the center of the capsule, i.e., below the pivot axis 34, on the two-piece capsule 1.

FIG. 3 shows the arrangement according to FIG. 2 in the situation in which an individual two-piece capsule 1 with its capsule top part 3 pointing downwardly is resting in upright position in the ejector passage 21 on its passage bottom 35. As in the arrangement according to FIG. 2, the horizontal pivot axis 34 is formed at the top capsule part 3 wherein however due to the reverse position of the two-piece capsule 1 the horizontal pivot axis 34 is now below the contact point 31. In respect to other features and reference characters, the arrangement according to FIG. 3 is identical to that of FIG. 2. Details to the effect of the illustrated arrangement will be explained infra.

FIG. 4 shows in a perspective schematic illustration a part of the separator block 4 according to FIG. 1 with an individual two-piece capsule 1 having been pushed in from above. The first clamping path 7 has a pair of clamping edges 11, 12 that are at least approximately parallel and are facing each other while the second clamping path 8 has a further pair of clamping edges 13, 14 that are at least approximately parallel and are facing each other. For configuring the pairs of clamping edges 11, 12 or 13, 14, a first pair of clamping plates 15, 16 as well as a second pair of clamping plates 17, 18 are provided. The first clamping path 7 is matched to the diameter $D_u$ of the capsule bottom part 2 (FIGS. 2, 3) while the second clamping path 8 is matched to the diameter $D_o$ of the capsule top part 3 (FIGS. 2, 3). In this connection, the clamping plates 15, 16 of the first clamping path 7 have between their facing clamping edges 11, 12 a spacing $a_1$ that is smaller by a certain clamping measure than the diameter $D_u$ of the capsule bottom part 2. The same applies also to the spacing $a_2$ between the two clamping plates 17, 18 or their facing clamping edges 13, 14 of the second clamping path 8 wherein the aforementioned spacing $a_2$ is smaller by a certain clamping measure than the diameter $D_o$ of the capsule top part 3. Since the diameter $D_u$ of the capsule bottom part 2 is smaller than the diameter $D_o$ of the capsule top part 3, the spacing $a_1$ between the clamping edges 11, 12 of the first clamping path 7 is smaller than the spacing $a_2$ between the clamping edges 13, 14 of the second clamping path 8. In any case, the spacings $a_1$, $a_2$ or their clamping measures are adjusted such that the respective capsule bottom part 2 or capsule top part 3 secured by clamping therebetween can be moved parallel to the clamping edges 11, 12 or the clamping edges 13, 14 but not in a direction perpendicular thereto. Accordingly, the clamping edges 11, 12, due to their spatial orientation, determine the aforementioned first advancing direction 9 of the first clamping path 7 while, in the same way, the clamping edges 13, 14, due to their spatial orientation, determine the second advancing direction 10 of the second clamping path 8. Coinciding with the illustration according to FIG. 1, the first pair of clamping plates 15, 16 is slanted relative to the second pair of clamping plates 17, 18 such that the pair of parallel clamping edges 11, 12 of the first clamping path 7 and thus the first advancing direction 9 is positioned at an opening angle $\alpha$ relative to the pair of parallel clamping edges 13, 14 of the clamping path 8 or relative to its second advancing direction 10.

The device according to the invention is operated with the following method steps. FIG. 1 shows the arrangement in the first method step according to which the capsule supply 23 is lowered onto the sorting block 20. At the lower end of the capsule supply 23 a retaining spring is arranged for the two-piece capsules 1 that are aligned in the capsule supply 23 and is retracted. As a result, the row of two-piece capsules stacked on each other will drop downwardly until an individual two-piece capsule 1 is positioned upright within the ejector passage 21 of the sorting block 20 in accordance with the illustration of FIG. 2. The sorting pusher 22 is positioned in a horizontally retracted position in which its tip 30 is positioned at a spacing relative to the two-piece capsule 1 standing in the ejector passage 21.

Figure 5:
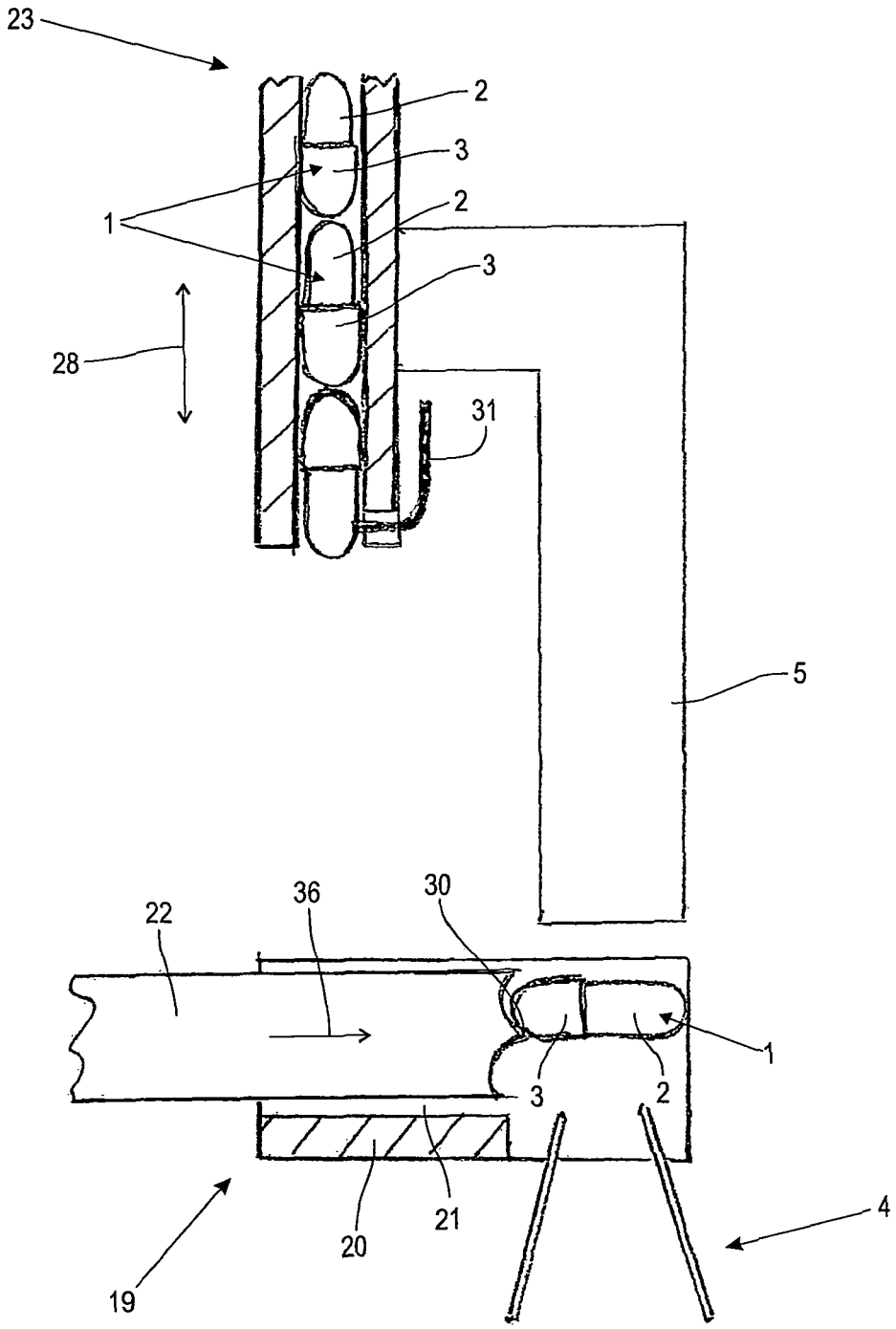
FIG. 5 the arrangement according to FIG. 1 at the beginning of the separating process.

FIG. 5 shows the arrangement according to FIG. 1 in the next method step, according to which the capsule supply 23 relative to the position of FIG. 1 is lifted. In this context, the retaining spring 31 projects into the passage of the capsule supply 23 so that the row of two-piece capsules 21 positioned therein is lifted together with the capsule supply 23 while only an individual two-piece capsule 1 is located within the sorting block 20. The sorting pusher 22, starting from the position according to FIG. 1, has moved horizontally into the ejector passage 21 of the sorting block 20. When looking jointly at FIGS. 1, 2 and 5, it is apparent that the sorting pusher 22 hits thereby with its tip 30 the contact point 32 of the two-piece capsule 1 and, as a result of its eccentricity to the horizontal pivot axis 34, causes a pivot movement of the two-piece capsule 1 in such a way that the two-piece capsule 1 with its capsule bottom part 2 pointing forwardly in the advancing or ejecting direction of the sorting pusher 22 is ejected from the ejector passage 21 and is positioned above the separator block 4. With additional attention to the illustration of FIG. 3, it is apparent that the same orientation of a two-piece capsule 1 is achieved even when it is resting with its capsule top part 3 pointing downwardly on the passage bottom 35 of the ejector passage 21. In this case, the contact point 32 is above the horizontal pivot axis 34 so that the sorting pusher 22 upon hitting the contact point 32 also causes turning of the two-piece capsule 1 in such a way that the two-piece capsule 1 with its capsule bottom part 2 pointing forwardly is ejected from the ejector passage 21 and will be positioned with the same orientation above the separator block 4.

Starting with the position of FIG. 5, in the next method step the capsule supply 23 together with the guide pusher 5 is lowered in the pushing direction 6 according to FIG. 1, wherein the guide pusher 5 will force the individual two-piece capsule 1, having been oriented with respect to the capsule bottom part 2 and capsule top part 3, into the separator block 4.

At the beginning, the initially closed two-piece capsule 1 is forced into the separator block 4 in the way illustrated in FIG.

4. In this context, the capsule bottom part 2 is secured with clamping action in the first clamping path 7 between the clamping edges 11, 12 while the capsule top part 3 is secured with clamping action in the second clamping path 8 between the clamping edges 13, 14. During the course of the further advancing stroke of the guide pusher 5 beginning with the position of FIG. 5 up to the end position according to FIG. 1 in the pushing direction 6, the two-piece capsule 1 is also pushed downwardly in the pushing direction 6. As a result of the afore described clamping and guiding action, the capsule bottom part 2 follows the first advancing direction 9 of the first clamping path 7 while the capsule top part 3 follows the second advancing direction 10 of the second clamping path 8. Since the two advancing directions 9, 10 relative to the pushing direction 6 (FIG. 1) are diverging at the opening angle $\alpha$, the capsule bottom part 2 which is moved in the first advancing direction 9 and the capsule top part 3 which is moved in the second advancing direction 10 are pulled apart so far that finally the capsule bottom part 2 and the capsule top part 3 are separated from each other in accordance with the illustration of FIG. 1.

At the same time, the capsule supply 23 is also lowered again in accordance with the illustration of FIG. 1 onto the sorting block 20 and the retaining spring 31 is retracted so that the next two-piece capsule 1 can drop into the ejector passage 21 of the sorting block 20 whereupon the afore described cycle will begin anew.

The illustration according to FIG. 1 also illustrates that the separated capsule bottom parts 2 and capsule top parts 3 fall onto the vibrating screen 25 arranged underneath the separator block 4 and remain thereon. As a result of the vibrating movement of the vibrating screen 25 in accordance with double arrow 27, the capsule contents, for example, in the form of the aforementioned fine-grain powder is shaken out of the capsule bottom parts 2 and capsule top parts 3 and passes through the vibrating screen 25 into the collecting container 26 arranged underneath. The vibrating screen 25 is of such a fine-mesh configuration that the capsule contents can pass through and is caught by the collecting container 26 while the capsule bottom parts 2 and capsule top parts 3 that have been ejected from the separator block 4 as well as possibly chipped-off capsule fragments are however retained. The capsule contents that is collected in the collecting container 26 is therefore free of any foreign material and can be subjected to further processing or used for refilling two-piece capsules 1.

What is claimed is:

1. A device for opening and emptying filled two-piece capsules, the device comprising:

a separator block;

a guide pusher adapted to push an individual two-piece capsule comprised of a capsule bottom part and a capsule top part into the separator block in a pushing direction;

wherein the separator block is adapted to separate the capsule bottom part from the capsule top part of the two-piece capsule;

wherein the separator block has a first clamping path for the capsule bottom part and a second clamping path for the capsule top part;

wherein the first clamping path has a first advancing direction and the second clamping path has a second advancing direction;

wherein the first and second clamping paths are designed such that the capsule bottom part is moved by the guide pusher in the first advancing direction along the first clamping path and the capsule top part is moved by the guide pusher in the second advancing direction along the second clamping path and wherein the capsule bottom part and the capsule top part are secured during movement along the first and second clamping paths by a clamping action acting perpendicularly to the first advancing direction and the second advancing direction, respectively;

wherein the first and second clamping paths are slanted relative to each other such that the first and second advancing directions diverge at an opening angle relative to the pushing direction of the guide pusher.

2. The device according to claim 1, wherein the first clamping path has a first pair of at least approximately parallel first clamping edges that are facing each other and the second clamping path has a second pair of at least approximately parallel second clamping edges that are facing each other, wherein the first pair of at least approximately parallel first clamping edges are positioned at the opening angle relative to the second pair of the at least approximately parallel second clamping edges.

3. The device according to claim 2, wherein the first and second pairs of the at least approximately parallel first and second clamping edges are formed on pairs of clamping plates, respectively.

4. The device according to claim 2, wherein a first spacing between the first clamping edges is smaller by a first clamping measure than a diameter of the capsule bottom part and a second spacing between the second clamping edges is smaller by a second clamping measure than a diameter of the capsule top part.

5. The device according to claim 1, further comprising a sorting device adapted to orient and align the two-piece capsule supplied to the separator block, wherein the sorting device is arranged upstream of the separator block, wherein the first clamping path is matched to a diameter of the capsule bottom part and the second clamping path is matched to a diameter of the capsule top part.

6. The device according to claim 5, wherein the sorting device comprises a sorting block that comprises an ejector passage for receiving the two-piece capsule that is unoriented and further comprises a sorting pusher adapted to orient and turn the two-piece capsule in the ejector passage and to discharge the two-piece capsule, oriented and turned, out of the ejector passage.

7. The device according to claim 6, wherein the sorting device comprises a capsule supply connected to the sorting block, wherein a lifting movement of the guide pusher is coupled with a lifting movement of the capsule supply.

8. The device according to claim 1, wherein the opening angle is in a range of including 10° to including 50°.

9. The device according to claim 8, wherein the range of the opening angle is including 20° to including 40°.

10. The device according to claim 9, wherein the opening angle is at least approximately 30°.

11. The device according to claim 1, further comprising a separating device arranged downstream of the separator block and adapted to separate the capsule bottom part and the capsule top part from a capsule contents of the two-piece capsule.

12. The device according to claim 11, wherein the separating device comprises a vibrating screen and a collecting container for the capsule contents arranged underneath the vibrating screen.

* * * * *